US005750022A

United States Patent [19]

Blake et al.

[11] Patent Number: 5,750,022

[45] Date of Patent: May 12, 1998

[54] VACUUM SYSTEM FOR REMOVAL OF DEBRIS FROM SWIMMING POOLS

[75] Inventors: Andy F. Blake, Phoenix; William C. Tarr, Waddell, both of Ariz.

[73] Assignee: Shasta Industries, Inc., Phoenix, Ariz.

[21] Appl. No.: 564,779

[22] Filed: Nov. 29, 1995

[51] Int. Cl.[6] ..... E04H 4/16

[52] U.S. Cl. ..... 210/169; 210/232; 210/237; 210/406; 210/416.2; 220/806; 220/378

[58] Field of Search ..... 210/169, 232, 210/237, 238, 258, 406, 416.2; 215/262, 341; 220/231, 352, 378, 806

[56] References Cited

U.S. PATENT DOCUMENTS

| | | | |
|---|---|---|---|
| 3,428,209 | 2/1969 | Brucker et al. | 220/378 |
| 3,443,264 | 5/1969 | Miller | 210/169 |
| 3,578,202 | 5/1971 | Mainet | 220/378 |
| 3,909,415 | 9/1975 | Young | 210/169 |
| 4,218,967 | 8/1980 | Batchelor | 220/231 |
| 4,219,423 | 8/1980 | Smith, Jr. | 210/169 |
| 4,718,129 | 1/1988 | Miller | 210/169 |
| 5,449,079 | 9/1995 | Yang | 220/231 |

*Primary Examiner*—Neil McCarthy
*Assistant Examiner*—Theodore M. Green
*Attorney, Agent, or Firm*—Cahill, Sutton & Thomas P.L.C.

[57] ABSTRACT

A swimming pool debris removal system includes a recirculating pump and a vacuum chamber having an access port, an inlet port, and an outlet port connected to a suction inlet of the pump. The inlet port is connected to receive water and debris pumped from the pool. A removable vacuum seal lid is disposed in the access port, forming a vacuum seal therewith. An air bleed tube coupled to the outlet port draws air trapped between the lid and water in the chamber into the outlet port and suction inlet when the pump is operating, causing the trapped air to be replaced by water and thereby reducing momentum forces of water in the chamber against the lid as the pump is turned off. The lid includes a disk with a circumferential groove and a handle attached to an upper surface of the disk. A resilient seal ring co-molded with the disk is attached to the plastic disk and disposed around a circumferential portion of the disk, and includes a base portion that engages the circumferential portion and is partially disposed in the first circumferential groove. The resilient seal ring also includes an inclined flange portion that extends outward and upward from the circumferential portion to provide slidable, vacuum sealing engagement with the access opening.

5 Claims, 2 Drawing Sheets

VACUUM SYSTEM FOR REMOVAL OF DEBRIS FROM SWIMMING POOLS

BACKGROUND OF THE INVENTION

The invention relates to a system in which water is drawn by a swimming pool pump through a main drain or a "mobile" or "robotic" pool cleaning device, an inlet connection to a vacuum chamber, a removable debris collection bag in the vacuum chamber, and into a suction inlet of the pump; the invention relates more specifically to maintaining a good vacuum in the chamber during pump operation and avoiding loosening of a removable lid of the vacuum chamber due to back pressure which occurs as the pump is turned off.

Intense summer wind/dust storms are common in various parts of the country, especially the Southwest desert regions, wherein large amounts of leaves, dust, and other debris are deposited in swimming pools, presenting a burdensome cleaning problem. Some known pool cleaning systems agitate the water to keep dust and debris in suspension in the pool water so that the dust and debris are removed by the pool filtering system. However, large debris blown into the pool by the intense summer wind/dust storms does not stay in suspension and settles to the bottom of the pool.

FIGS. 3 and 4 show a prior art removable vacuum seal lid 40 used in a prior art pool cleaning system including a vacuum chamber in which a removable debris collection bag collects debris carried by water pumped from a main drain of a pool. Vacuum seal lid 40 includes a rigid plastic disk 41 having a circumferential groove 43 therein. Groove 43 has a rectangular cross section. A knob or handle 55 is attached to the upper surface of disk 41 and offset from the center of lid 40 so it tilts as it is lifted to cause a vacuum seal to be broken when lid 40 is pulled upward out of an access port of the vacuum chamber to allow the debris collection bag to be removed. (It should be understood that the term "vacuum" as used herein refers to a partial vacuum the amount of which corresponds to the pressure reduction produced at the suction inlet of an ordinary swimming pool recirculation pump.) A "U seal" gasket 42 composed of approximately 90 durometer plastic is disposed in groove 43. U seal gasket 42 is marketed under the trademark PARAFLEX by Parker Corporation. The cross-section of gasket 42 is U-shaped, and includes an outer section or flap 42A, a bottom section 42B, and an inner section 42C. The upper part of section 42A is flared out slightly, by approximately 5 degrees from a tangent plane of the lower part of section 42A to engage and provide a vacuum seal with the inner surface of the access port to the vacuum chamber. The design of FIGS. 3 and 4 was provided to improve the vacuum seal of an earlier prior art lid that included a soft O-ring disposed in a circular, annular groove on the bottom surface of a disk such that a vacuum in the chamber pulled the disk toward a seal surface tending to partly crush the O-ring and thereby improve the vacuum seal. The prior attempts by the present assignee to provide a suitable removable seal lid for a vacuum chamber containing a debris collection bag resulted in reliability problems that were difficult to solve. The U seal gasket often did not conform adequately to irregularities of the inner surface of the access port. Maintenance personnel frequently attempted to put lubricant material, such as silicone grease, on the above mentioned O-ring seal when vacuum leaks occurred. Such lubricant tended to collect grit, which resulted in further vacuum air leaks, making the problem worse.

Another problem with the use of the above mentioned closest prior art vacuum seal lids is that when the pool pump is turned off, the effect of water momentum in the piping between the pool drain or mobile cleaning device and the suction inlet of the pump tends to produce a sudden increase in water pressure in the vacuum chamber, tending to slam a column of water in the vacuum chamber against the bottom of the lid and pop it out of the access port. This problem is made worse by the presence of a pocket of trapped air between the bottom surface of the lid and the level of water in the vacuum chamber. The pocket of trapped air allows the column of water to build up momentum before it hits the bottom of the lid.

Various automated pool cleaning systems have been devised to ease the task of maintaining swimming pool surfaces free of such settled debris. Commonly assigned patent application "VACUUM-BOOSTED AUXILIARY SWIMMING POOL DRAIN/FILTER SYSTEM" (Blake et al.) filed Jan. 13, 1992, Ser. No. 821,393, incorporated herein by reference, describes one such prior art system which was marketed more than one year ago by the present assignee. Some pool cleaning systems use "robotic" or "mobile" cleaning devices, such as those marketed under the trademarks "KREEPY KRAWLEY", BARACUDA, and POOL VAC. Such mobile/robotic cleaning devices move along and clean bottom and/or side surfaces of a swimming pool, and are connected by a long flexible suction hose to a pipe that is connected to the suction inlet of the pool pump.

The prior art pool cleaning systems all include a "hair and lint" trap located at the suction inlet of the recirculation pump. This trap usually is small in size, with a capacity of roughly one quart. It is contained in a metal housing having a lid which typically is removed by unscrewing several bolts. An O-ring gasket is provided on the lid so that when the lid is tightened, a good vacuum seal is maintained at the suction side of the pump when it is running. The low capacity of such hair and lint traps and the necessity to unscrew the lid to remove it from the housing to empty the hair and lint trap causes considerable inconvenience to pool owners. Furthermore, every time the hair and lint trap is removed and emptied, the "priming" of the pool pump is lost. Usually, the pump must run "dry" for roughly a half a minute or so to "prime" the pump before effective recirculation of pool water can occur. In older pools, various "vacuum" leaks may have developed in the pool plumbing, increasing the amount of time the pool pump must run dry before it becomes primed with pool water. The longer the pool pump runs dry, the faster the pool pump seals become damaged.

It would be very desirable to improve the foregoing prior art automated cleaning systems by reducing the frequency with which a debris trap, especially a hair and lint trap, must be removed and emptied. It also would be very desirable to avoid the inconvenience of removing the lid of a typical hair and lint trap housing. It also would be very desirable to provide a system in which collected debris can be conveniently removed without causing the pool pump to "lose its prime".

SUMMARY OF THE INVENTION

Accordingly, it is an object of the invention to provide a reliable, inexpensive swimming pool cleaning system including a vacuum chamber with a removable debris collection bag therein.

It is another object of the invention to provide, in a swimming pool cleaning system, a reliable, removable vacuum seal lid for an access port of a vacuum chamber having therein a removable debris collection bag.

It is another object of the invention to provide an improved, low cost vacuum seal lid which readily and reliably accommodates variations in the inside diameter of a vacuum chamber constructed of a section of large-diameter PVC pipe.

It is another object of the invention to provide an improved, lower cost vacuum seal lid and a method of making such lid.

It is another object of the invention to avoid loosening of a vacuum seal lid in a debris bag vacuum chamber of a swimming pool cleaning system as a result of water momentum force against the lid as the pool pump is turned off.

It is another object of the invention to provide a low cost, reliable swimming pool cleaning system which makes it unnecessary to frequently remove and empty a conventional hair and lint trap.

It is another object of the invention to provide a reliable, low cost swimming pool cleaning system which does not cause the pool pump to "lose its prime" when a debris filtering device is removed, emptied, and replaced.

It is another object of the invention to provide a reliable, low cost pool cleaning system in which a removable debris filtering device is more conveniently located than is the case for most conventional hair and lint traps.

Briefly described, and in accordance with one embodiment thereof, the invention provides a swimming pool debris removal system including a recirculating pump having a suction inlet and a vacuum chamber with an access port, an inlet port, and an outlet port. The inlet port is connected to receive water and debris pumped from the pool. A suction pipe is connected between the suction inlet of the pump and the output port of the vacuum chamber. A removable vacuum seal lid is disposed in the access port of the vacuum chamber. In the described embodiment, the lid includes a plastic disk having an upper surface, a lower surface, and a circumferential portion having at least a circumferential groove therein, and an offset handle attached to the upper surface. A resilient seal ring is attached to the plastic disk and disposed around the circumferential portion. The seal ring includes a base portion engaging the circumferential portion and partially disposed in the circumferential grooves. The seal ring also includes an inclined flange portion extending outward and upward from the circumferential portion to provide a slidable, vacuum sealing engagement with an inner surface of the access opening.

The lid is made by providing an injection mold apparatus having a first cavity region defining a disk shape with a circumferential portion and at least one circumferential groove portion in the circumferential portion. First melted plastic material is injected into the first cavity region and allowed to solidify to form a rigid disk having a circumferential portion and at least one circumferential groove in the circumferential portion of the rigid disk. A second cavity region is provided to define a seal ring portion contiguous with the circumferential portion of the rigid disk in the injection mold apparatus, with the circumferential portion of the rigid disk partially forming the second cavity region. Second melted plastic material is injected into the second cavity region and allowed to solidify into a resilient seal ring co-molded with, extending beyond, and securely attached to the rigid disk.

The pump is operated to draw debris-carrying water from the pool through the chamber and a removable debris filtering device in the vacuum chamber to trap the debris therein. The pump then is turned off, and the lid is manually lifted from the access port, causing the resilient seal ring of the lid to separate from the surface of the access port and release a vacuum in the chamber. The debris filtering device is removed from the chamber, emptied of the trapped debris, and replaced in the chamber. The lid is pressed into the access port to cause the resilient seal ring to form a vacuum seal. The pump is turned on, creating suction at the outlet port, and drawing air trapped in a region under the lid out of the region into water at the outlet, to thereby cause the region to be filled with water and eliminate water momentum forces on a bottom surface of the lid when the pump is turned off.

DETAILED DESCRIPTION OF THE PREFERRED EMBODIMENTS

Figure 1:
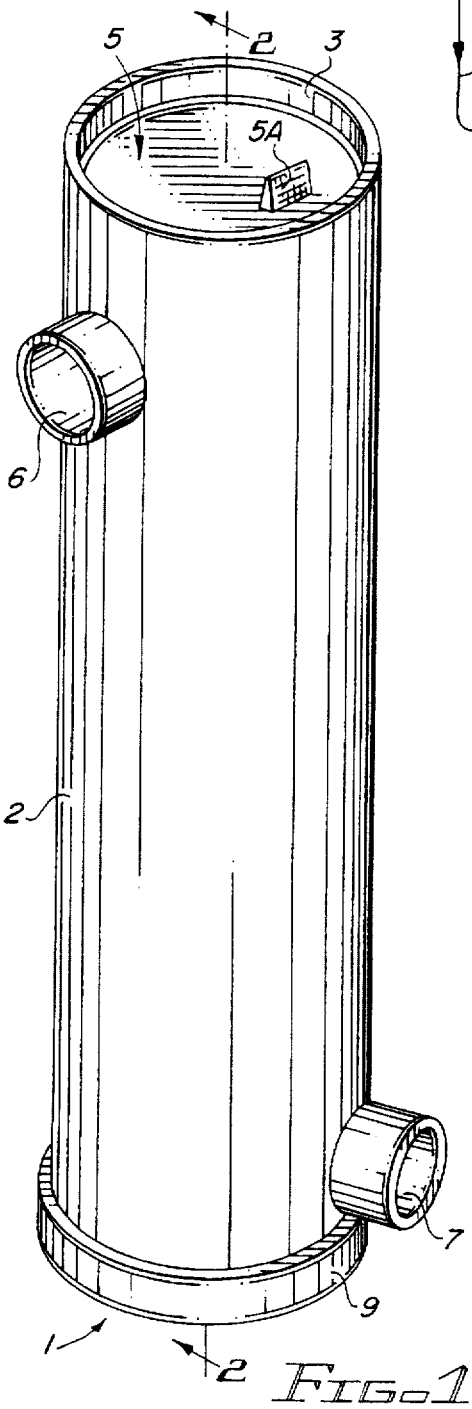
FIG. 1 is a perspective view of a vacuum chamber in which a removable debris collection bag is provided in the circuit between a suction inlet of a swimming pool pump and a main drain or mobile pool cleaning apparatus.
Figure 2:
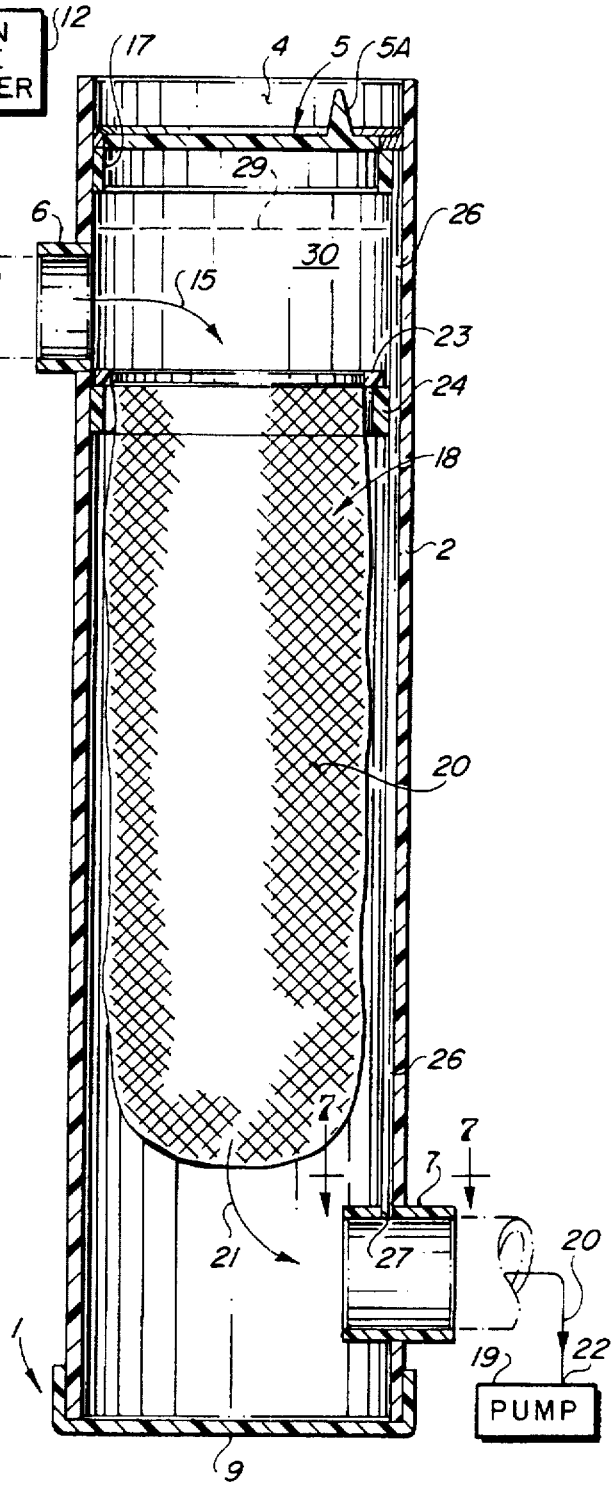
FIG. 2 is a section view along section line 2—2 of FIG. 1 and further including additional elements of the system.

Referring now to FIGS. 1, 2, and 5–7, an improved system, which was developed to solve the above problems of the above mentioned closest prior art, includes a vacuum chamber 1 having a cylindrical body 2. Body 2 typically is a section of Schedule 40 PVC pipe having an inside diameter of 6 inches and a height of approximately 2 feet. A PVC inlet port 6 is cemented to body 2 approximately 5 ½ inches from the upper end thereof. As indicated in block 12, a conduit schematically designated by line 13 in FIG. 2 is connected to either a main drain of a swimming pool or to a mobile pool cleaning device therein. The inlet 6 can be composed of Schedule 40 PVC pipe of suitable diameter. Similarly, an outlet 7 of vacuum chamber 1 is attached to the lower end of the body 2 approximately 1.5 inches from the bottom edge thereof. (Note that the dimensions indicated herein are not at all critical.) Outlet 7 is connected by a pipe or tube 20 to outlet port 7. A molded PVC cap 9 is cemented to the bottom end of body 2 to provide a sealed bottom of vacuum chamber 1.

A ring-shaped debris bag support 24 is glued to the cylindrical inside surface of body 2 approximately 9 inches below the upper edge thereof. Debris bag support 24 can be composed of a section of 6 inch diameter Schedule 40 PVC pipe, with a segment of several inches removed to perform a C-shaped configuration having a gap indicated by numeral 25 in FIG. 7. A vacuum lid stop 17, which is essentially identical to debris bag stop 24, is cemented to the inside surface of body 2 approximately 1 ½ inches from the upper edge thereof, with its gap 25 vertically aligned with the gap 25 of lower stop 24.

In FIG. 2, numeral 18 illustrates the removable debris collection bag, which includes a rigid support collar 23 to which the porous fabric or net material 20 is attached.

Figure 5:
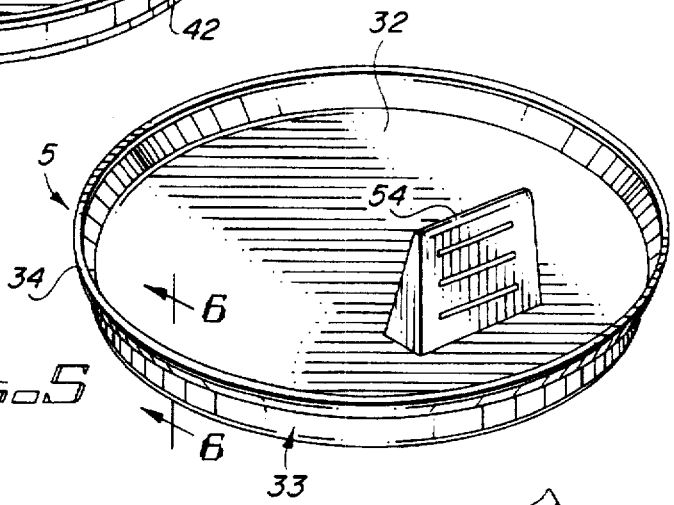
FIG. 5 is a perspective view of the removable vacuum seal lid included in FIG. 1.
Figure 6:
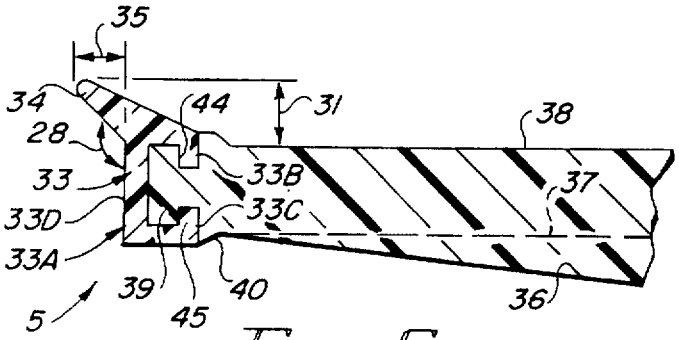
FIG. 6 is a partial section view taken along section line 6—6 of FIG. 5.

An improved vacuum lid 5, shown in FIGS. 5 and 6, is inserted into the access port 4 of vacuum chamber 1 of the upper end of body 2 and provides an improved vacuum seal for vacuum chamber 1. A plastic "air bleed" tube 26, which can be PVC tubing one fourth of an inch in diameter, extends from an opening 27 just inside the wall of body 2 in the top of outlet 7 and extends upward along the inside wall of body 2 through the aligned gaps 25 in to a height approximately a quarter of an inch below the top edge of stop 17.

In accordance with one aspect of the present invention, when pump 19 is running, suction from inlet 22 of pump 19 produces a partial vacuum inside air bleed tube 26 which removes any air trapped between the bottom of vacuum lid 5 and the initial water level (i.e., the level of the water in the pool when lid 5 is removed) shown by dotted line 29 inside vacuum chamber 1. This prevents a column of water inside vacuum chamber 1 from moving forward and building up momentum toward the bottom of lid 5 when the pump 19 is abruptly stopped, and thereby prevents "hammering" of the bottom of vacuum lid 5 by the rising column of water. This prevents lid 5 from being loosened or knocked out of access port 4 as the pump is turned off.

In accordance with another aspect of the present invention, the configuration of vacuum lid 5 is substantially improved over the prior art configuration described above with reference to FIGS. 3 and 4. Vacuum lid 5 includes a disk-shaped portion 32 from which a plurality of radial, tapered reinforcement webs 36 extend downwardly from lower surface 37 of disk 32 to thereby provide adequate strength, while requiring less plastic material. Disk 32 preferably is made of ABS plastic or polycarbonate. Disk 32 includes a T-shaped circumferential portion including a pair of annular grooves 44 and 45 on the upper surface 38 and the lower surface 37, respectively, of disk 32 and a circumferential portion 39. Disk 32 of vacuum lid 5 is injection molded first. Then, the seal material, which preferably is approximately 80 durometer olenifinac propylene base material plastic marketed by DuPont under the trademark SANOPRENE, is "co-molded" with disk 38 by injecting melted SANOPRENE material into an injection mold cavity partly defined by disk 32 to form resilient seal ring 33. The melting points of ABS plastic or polycarbonate are approximately the same as the SANOPRENE material. Consequently, the co-molding process results in a very secure interface between resilient seal ring 33 and the circumferential portion of disk 32.

A flared lip 34 of seal ring 33 extends at an obtuse angle 28 of approximately 135 degrees relative to the surface 33A of sealing ring 33 (which is the same as the complementary acute angle of 45 degrees from a tangent plane of surface 33A). Portions 33B and 33C of the injected SANOPRENE plastic fill annular grooves 44 and 45, respectively. As a consequence of the above "co-molding" process and the circumferential T-shaped configuration of disk 38, seal ring 33 adheres very strongly to the periphery of disk 32. (Note that it would be impractical to use such a "co-molding" process to co-mold the prior art seal ring 45 shown in FIGS. 3 and 4 to disk 44 because it would be impractical to pull the co-molded part out of the mold.) When the process is complete, the extreme tip of flange 34 extends approximately 170 mils beyond the vertical surface 33D as indicated by arrow 35. The tip of flange 34 also extends approximately 345 mils above the top surface 38 of disk 32, as indicated by arrow 31. Portion 33A of seal ring 33 is approximately 90 mils thick.

Figure 3:
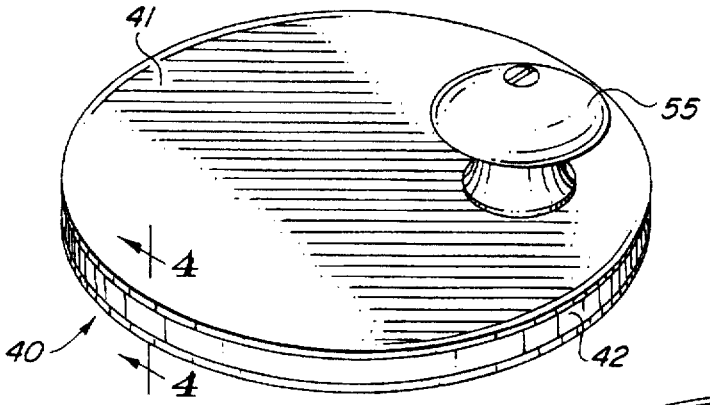
FIG. 3 (PRIOR ART)
FIG. 3 is a perspective view of a prior art lid for maintaining a vacuum seal in a debris collection chamber.
Figure 4:
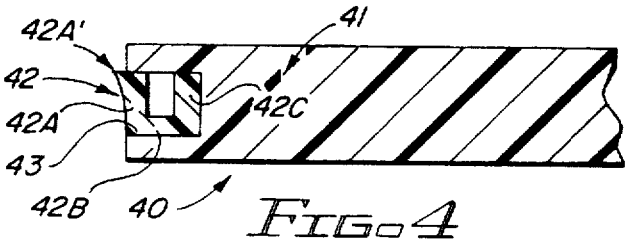
FIG. 4 (PRIOR ART)
FIG. 4 is a partial section view taken along section line 4—4 of FIG. 3.
Figure 7:
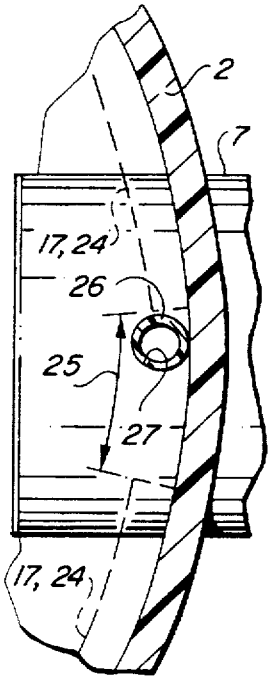
FIG. 7 is a partial section view taken along section line 7—7 of FIG. 2.

The above described prior art vacuum lid structure 40 of FIGS. 3 and 4 fails to provide and adequate seal, partly because the available U-seal type gaskets are not sufficiently resilient to accommodate normal variations in the inside diameter of the 6 inch schedule 40 PVC pipe of which body 2 is composed. Such variations are due both to manufacturing tolerance variations in the inside diameter and deformations in the body 2 as cement pool decking material is poured to embed the vacuum chamber in the pool decking material adjacent to the pool.

In operation, when pump 22 is turned on, water flows the pool drain or mobile pool cleaner into inlet 6 of vacuum chamber 1, and as indicated by arrow 15, into the open top of debris collection bag 18, through the porous fabric 20 thereof, into outlet port 7, through tube 20, and into the suction inlet 22 of pump 19. Vacuum lid 5 prevents air from entering vacuum chamber 1 through access port 4. After pump 22 is turned on, suction in outlet port 7 draws trapped air through bleed tube 26 and out of the region between the initial water level 29 in vacuum chamber 1 and the bottom of vacuum lid 5, so the water level rises to the bottom of the lid 5. This avoids "momentum hammering" of a rapidly rising column of water against the bottom of lid 5 as pump 19 is turned off.

The above indicated dimensions and materials of which vacuum lid 5 is composed allow it to be easily removed by means of off-center handle 5A, whereby the owner can reach through access port 4, lift debris collection bag 18 out, empty collected debris from it, replace bag 18 in vacuum chamber 1, and press lid 5 into place against stop 17. The assignee's testing and recent commercial use of this lid in conjunction with the above mentioned prior art system described in the incorporated-by-reference Blake et al. application has proven it to be reliable and a substantial improvement over the prior art vacuum lid of FIGS. 3 and 4.

While the invention has been described with reference to several particular embodiments thereof, those skilled in the art will be able to make the various modifications to the described embodiments of the invention without departing from the true spirit and scope of the invention. It is intended that all combinations of elements and steps which perform substantially the same function in substantially the same way to achieve the same result are within the scope of the invention. For example, annular grooves 44 and/or 45 might be omitted if a sufficiently strong bond is provided (for example by suitable adhesive or chemical bonding) between the inner surface of resilient seal ring 33 and the mating circumferential surface of disk 32. It should be appreciated that if the water level indicated by dotted line 29 in FIG. 2, which is the same as the water level of the swimming pool with the vacuum seal lid 5 removed, is always above the upper edge of stop 17, then there will never be any trapped air between the initial water level and vacuum chamber 1 and the bottom of lid 5, because lid 5 usually is tilted as it is inserted into access port 4, allowing any air to escape and thereby preventing it from being trapped. In this case, there would be no need for air bleed tube 26.

What is claimed is:

1. A swimming pool debris removal system, comprising in combination:

(a) a recirculating pump having a suction inlet;

(b) a vacuum chamber having an access port, an inlet port, and an outlet port, the inlet port being connected to receive water and debris suspended in water pumped from the pool by the pump;

(c) tubing connected between the suction inlet of the pump and the output port of the vacuum chamber;

(d) a removable vacuum seal lid disposed in the access port and forming a vacuum seal with an inner surface of the access port; (e) wherein the removable vacuum seal lid includes (1) a disk including an upper surface, a lower surface, and a circumferential portion having a first annular groove therein, a handle attached to the upper surface; and (2) a resilient seal ring attached to the plastic disk and disposed around the circumferential portion, the seal ring including i. a base portion engaging the circumferential portion, and ii. an inclined flange portion extending outward and upward from the circumferential portion to provide slidable, vacuum sealing engagement with an irregular inner surface of the access port.

2. The swimming pool debris removal system of claim 1 wherein the resilient seal ring is comprised of approximately 80 durometer plastic material.

3. The swimming pool debris removal system of claim 2 wherein a surface of the inclined flange portion is inclined approximately 45 degrees from a plane tangent to a surface of the base portion.

4. The swimming pool debris removal system of claim 3 wherein the lid includes a second annular groove in the circumferential portion, the first annular groove being disposed in the upper surface of the disk and the second annular groove being disposed in the lower surface of the disk.

5. A swimming pool debris removal system, comprising in combination:

(a) a recirculating pump having a suction inlet;

(b) a vacuum chamber having an access port, an inlet port, and an outlet port, the inlet port being connected to receive water and debris suspended in water pumped from the pool by the pump;

(c) tubing connected between the suction inlet of the pump and the output port of the vacuum chamber;

(d) a removable vacuum seal lid disposed in the access port and forming a vacuum seal with an inner surface of the access port; and (e) a lid stop attached to an inner surface of the access port above the inlet port to limit insertion of the lid into the access port at a level which allows insertion of the lid into the access port such that essentially no air is trapped between a bottom of the lid and water in the vacuum chamber.

* * * * *